US008646780B1

(12) United States Patent
Spencer

(10) Patent No.: US 8,646,780 B1
(45) Date of Patent: Feb. 11, 2014

(54) COIN DROPPING GAME SYSTEM

(76) Inventor: Wayne Spencer, Tampa, FL (US)

( * ) Notice: Subject to any disclaimer, the term of this patent is extended or adjusted under 35 U.S.C. 154(b) by 1068 days.

(21) Appl. No.: 12/316,419

(22) Filed: Dec. 12, 2008

(51) Int. Cl.
*A63F 9/00* (2006.01)

(52) U.S. Cl.
USPC ..... 273/457

(58) Field of Classification Search
USPC ..... 273/457, 138.5, 447, 412, 440; 40/541, 40/546, 549, 559
See application file for complete search history.

(56) References Cited

U.S. PATENT DOCUMENTS 943,146 A 12/1909 Goehst
4,177,986 A 12/1979 Campbell
4,418,912 A 12/1983 Tottey
5,282,636 A 2/1994 Wyman
5,301,942 A * 4/1994 Lacrosse ..... 273/138.3
5,857,910 A * 1/1999 Watanabe et al. ..... 463/17
6,367,801 B1 4/2002 Spencer

* cited by examiner

*Primary Examiner* — Raleigh W Chiu
(74) *Attorney, Agent, or Firm* — Edward P Dutkiewicz

(57) ABSTRACT

A coin dropping game system has a lower base and an upper base. A housing has open upper end and an open bottom end which is coupled to the top of the upper base. A lid having a lip is positioned over, and encloses, the upper end of the housing. A vertical support shaft has a lower end rotatably coupled with respect to the upper base and an upper end extending upwardly through the central aperture in the lid. The shaft has associated plates, having coin receiving surfaces. A base support plate is formed with a central aperture for rotatably receiving the lower end of the vertical support shaft.

3 Claims, 4 Drawing Sheets

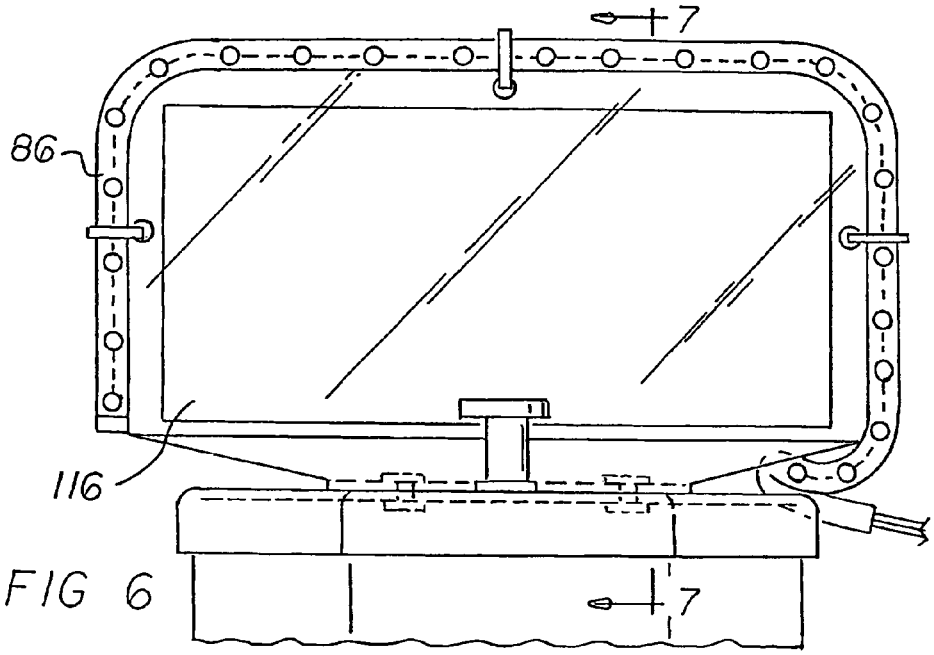
FIG 6
FIG 7
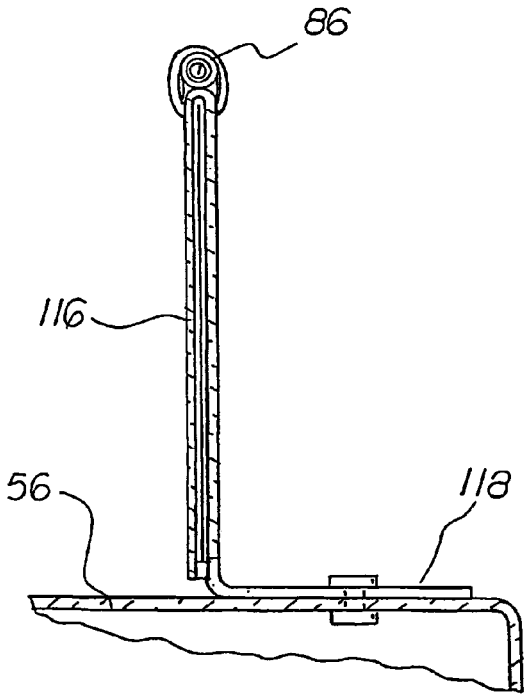

COIN DROPPING GAME SYSTEM

NEW RULE 1.78(F) (1) DISCLOSURE

The Applicant has not submitted a related pending or patented non-provisional application within two months of the filing date of this present application. The invention is made by a single inventor, so there are no other inventors to be disclosed. This application is not under assignment to any other person or entity at this time.

RELATED PATENT APPLICATIONS

This application is based upon U.S. Utility patent application Ser. No. 10/746,414 filed Dec. 24, 2003 and presently pending.

BACKGROUND OF THE INVENTION

1. Field of the Invention

The present invention relates to a coin dropping game system and more particularly pertains to testing the manual dexterity of a player dropping a coin while turning a coin-receiving surface.

2. Description of the Prior Art

The use of games of known designs and configurations wherein coins are dropped or tossed is known in the prior art. More specifically, games of known designs and configurations wherein coins are dropped or tossed previously devised and utilized for the purpose of determining the manual dexterity of a game player through known methods and apparatuses are known to consist a basically of familiar, expected, and obvious structural configurations, notwithstanding the myriad of designs encompassed by the crowded prior art which has been developed for the fulfillment of countless objectives and requirements.

While the prior art devices fulfill their respective, particular objectives and requirements, the aforementioned patents do not describe a coin dropping game system that allows testing the manual dexterity of a player dropping a coin while turning a coin-receiving surface.

In this respect, the coin dropping game system according to the present invention substantially departs from the conventional concepts and designs of the prior art, and in doing so provides an apparatus primarily developed for the purpose of testing the manual dexterity of a player dropping a coin while turning a coin-receiving surface.

Therefore, it can be appreciated that there exists a continuing need for a new and improved coin dropping game system which can be used for testing the manual dexterity of a player dropping a coin while turning a coin-receiving surface. In this regard, the present invention substantially fulfills this need.

SUMMARY OF THE INVENTION

In view of the foregoing disadvantages inherent in the known types of games of known designs and configurations wherein coins are dropped or tossed now present in the prior art, the present invention provides an improved coin dropping game system. As such, the general purpose of the present invention, which will be described subsequently in greater detail, is to provide a new and improved coin dropping game system and method which has all the advantages of the prior art and none of the disadvantages.

To attain this, the present invention essentially comprises a system including a lower base of an opaque plastic material. The lower base has a horizontal lower plate and an open top.

The lower base also has vertical side walls between its lower plate and open top. Elastomeric pads are secured to the lower face of the lower base as shown in the bottom of FIG. 2 in order to abate vibrations. The lower base is formed in a six-sided symmetrical configuration. Next provided is an upper base of an opaque plastic material. The upper base has a horizontal lower plate and an open top. The upper base also has vertical side walls between its lower plate and open top. The upper base is also formed in six-sided symmetrical configuration. The lower plate of the upper base is larger than the open top of the lower base. The lower plate of the upper base is centrally positioned upon the open top of the lower base.

A housing is next provided. The housing is fabricated of a plastic material. The housing has an open upper end. The housing also has an open bottom end coupled to the top of the upper base. The housing also has a transparent side wall between its open upper end and its open bottom end. The housing is also formed in a symmetric six-sided configuration. A chamber is formed within the housing.

A lid is next provided. The lid is positioned over the upper end of the housing. A central aperture and a plurality of slots are provided through the lid. A horizontal slot in the lid receives a projection formed in the housing to secure the coupling there between.

A vertical support shaft is next provided. The vertical support shaft has a lower end and an upper end extending upwardly through the central aperture in the lid. A handle is provided on the upper end of the support shaft for being turned by a player. The support shaft has five axially spaced horizontal plates. Each of the plates is formed with a plurality of planar coin-receiving surfaces, preferably two surfaces per plate. Note FIG. 5. Each of the coin-receiving surfaces is in a generally pie-shaped configuration. Cutouts are provided between the surfaces. The coin-receiving surface of the upper plate is greater in size than the size of the coin-receiving surfaces of the plates beneath the coin-receiving surface of the upper plate. The plates and coin-receiving surfaces are adapted to be rotated by a player upon the rotation of the upper end of the shaft.

A base support plate is next provided. The base support plate is removably positionable in the chamber of the housing. The base support plate is formed with a central aperture for rotatably receiving the lower end of the vertical support shaft and a radially exterior periphery with six outwardly extending fingers positionable in close proximity to the housing. The base support plate also has a flat lower surface and an upper surface tapering downwardly from the central aperture.

Next provided are security in components between the lid and the housing. The security components include adjacent holes in the lid and the housing and a padlock for selectively locking and unlocking the lid onto the housing to secure coins within the housings. A vertical sign is provided for supporting indicia relating to the nature of the game and prizes to be won and charities to be helped. The sign includes a horizontal lower extension formed with an aperture and a fastener for removably joining the sign to the upper end of the housing. In this manner when a coin is dropped through one of the slots and the handle is turned by the player, a coin may fall and possibly rest on one of the plates. Upon further movement of the plates, the coin may possibly be moved to rest on one of the lower plates with the score of the player increasing as a function of the lower most plate in which the player may make a coin rest.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved coin dropping game system which has all of the advantages of the prior art games of known designs and configurations wherein coins are dropped or tossed and none of the disadvantages.

It is another object of the present invention to provide a new and improved coin dropping game system which may be easily and efficiently manufactured and marketed.

It is further object of the present invention to provide a new and improved coin dropping game system which is of durable and reliable constructions.

An even further object of the present invention is to provide a new and improved coin dropping game system which is susceptible of a low cost of manufacture with regard to both materials and labor, and which accordingly is then susceptible of low prices of sale to the consuming public, thereby making such coin dropping game system economically available to the buying public.

Even still another object of the present invention is to provide a coin dropping game system for testing the manual dexterity of a player dropping a coin while turning a coin-receiving surface.

Lastly, it is an object of the present invention to provide a new and improved coin dropping game system having a lower base and an upper base. A housing is fabricated of a plastic material with an open upper end, an open bottom end coupled to the top of the upper base, and a transparent side wall. A lid is positioned over the upper end of the housing. A central aperture is provided through the lid. A vertical support shaft has a lower end rotatably coupled with respect to the upper base and an upper end extending upwardly through the central aperture in the lid. A handle on the upper end of the vertical support shaft is provided. The support shaft has axially spaced horizontal plates. Each of the plates is formed with a plurality of coin-receiving surfaces.

A base support plate is removably positionable in the chamber of the housing. The base support plate is formed with a central aperture for rotatably receiving the lower end of the vertical support shaft and a radially exterior periphery with a plurality of outwardly extending fingers positionable in close proximity to the housing. The base support plate also has an upper surface tapering downwardly from the central aperture.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated various embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 6 is a front elevational view of a sign constructed in accordance with the principles of an alternate embodiment of the present invention.

FIG. 7 is a cross-sectional view taken along line 7-7 of FIG. 6.

The same reference numerals refer to the same parts throughout the various Figures and the various embodiments of the invention.

DESCRIPTION OF THE PREFERRED EMBODIMENT

Figure 1:
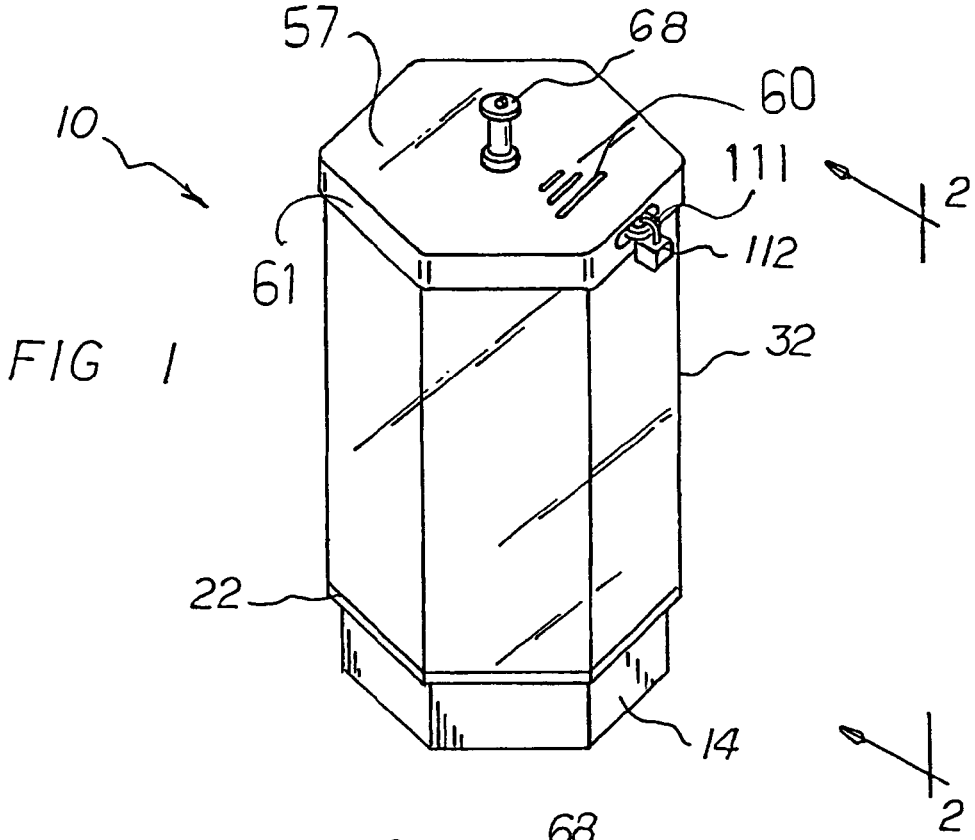
FIG. 1 is a perspective illustration of the coin dropping game system constructed in accordance with the principles of the present invention.

With reference now to the drawings, and in particular to FIG. 1 thereof, the preferred embodiment of the new and improved coin dropping game system embodying the principles and concepts of the present invention and generally designated by the reference numeral 10 will be described.

The present invention, the coin dropping game system 10 is comprised of a plurality of components. Such components in their broadest context include a lower base, an upper base, a housing, a lid, a vertical support shaft and a base support plate. Such components are individually configured and correlated with respect to each other so as to attain the desired objective.

Figure 2:
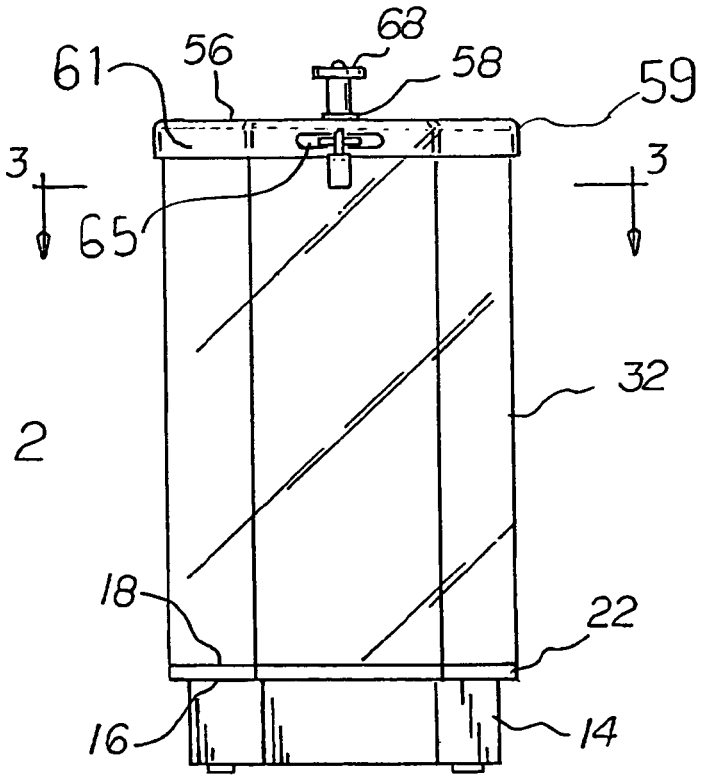
FIG. 2 is a side elevational view taken along line 2-2 of FIG. 1.
Figure 3:
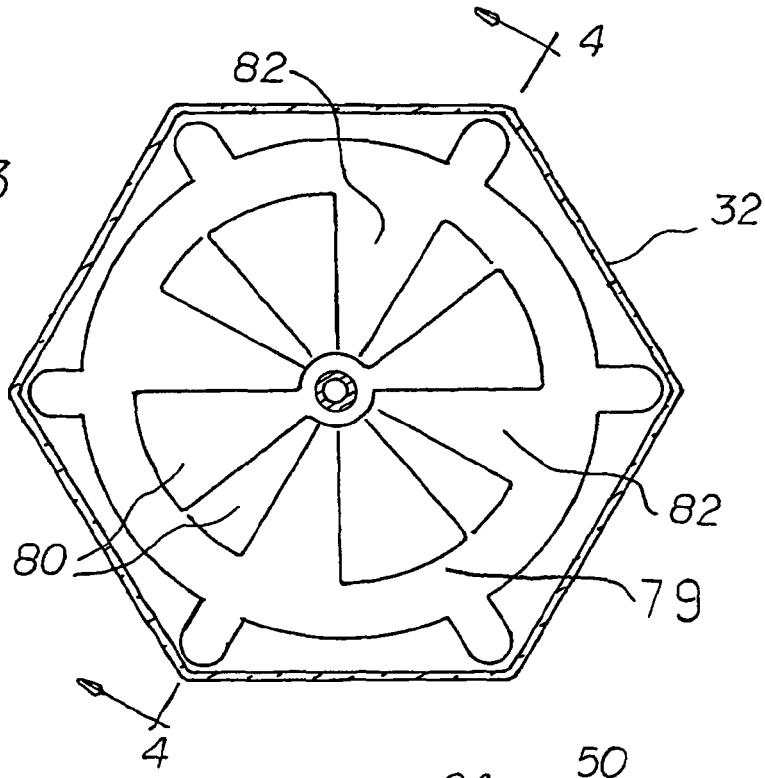
FIG. 3 is a cross sectional view taken along line 3-3 of FIG. 2.
Figure 4:
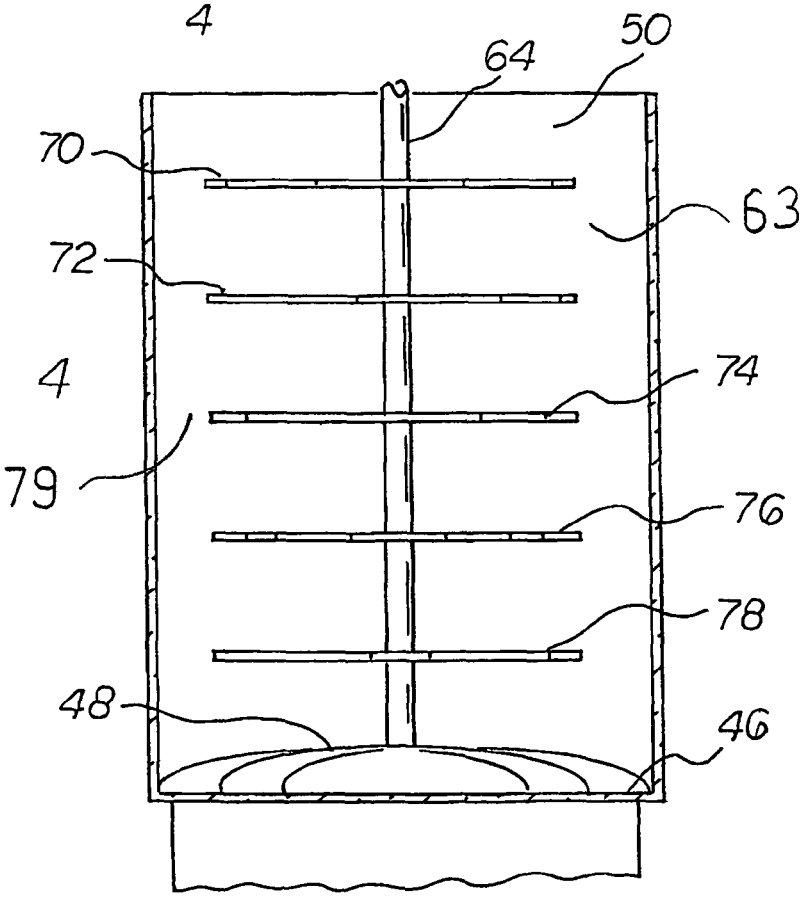
FIG. 4 is a front elevational view of the upper components shown in FIGS. 1 and 2 with parts broken away to show certain internal construction.

First provided is a lower base 14 of an opaque plastic material. The lower base has a horizontal lower plate 16 and an open top 18. Elastomeric pads are secured to the lower face of the lower base as shown in the bottom of FIG. 2 in order to abate vibrations. The lower base also has vertical side walls between its lower plate and open top. The lower base is formed in a six-sided symmetrical configuration. Other configurations could readily be utilized.

Next provided is an upper base 22 of an opaque plastic material. The upper base has a horizontal lower plate and an open top. The upper base also has vertical side walls between its lower plate and open top. The upper base is also formed in six-sided symmetrical configuration. The lower plate of the upper base is larger than the open top of the lower base. The lower plate of the upper base is centrally positioned upon the open top of the lower base.

A housing 32 is next provided. The housing is fabricated of a plastic material. The housing has an open upper end. The housing also has an open bottom end coupled to the top of the upper base. The housing also has transparent side walls between its open upper end and its open bottom end. The housing is also formed in a symmetric six-sided configuration. A chamber 50 is formed within the housing. The housing has a first exterior diameter.

A lid 56 is next provided. The lid has a upper exterior surface 57 and an interior surface 59. The lid is positioned over the upper end of the housing. The lid has a downwardly projecting lip 61. The lip is oriented at approximately a right angle to the top surface of the lid and forms an interior area for receiving the upper end of the housing. The lid has a second interior diameter, with the second interior diameter being greater than the first exterior diameter of the housing, thereby receiving the housing into the lid. The lid also has a third exterior diameter. The third diameter is larger than the second diameter. The lid has a central aperture 58 and a plurality of slots 60 are provided through the lid. A horizontal slot in the lid receives a projection formed in the housing to secure the coupling there between. The upper exterior surface is in contact with the ambient atmosphere. The apertures through the lid, then, allow the continuation of the atmosphere into the interior of the chamber, with the atmosphere being continuous within the chamber 63. The lid lip has a slot 65 therein for receiving a locking mechanism.

Figure 5:
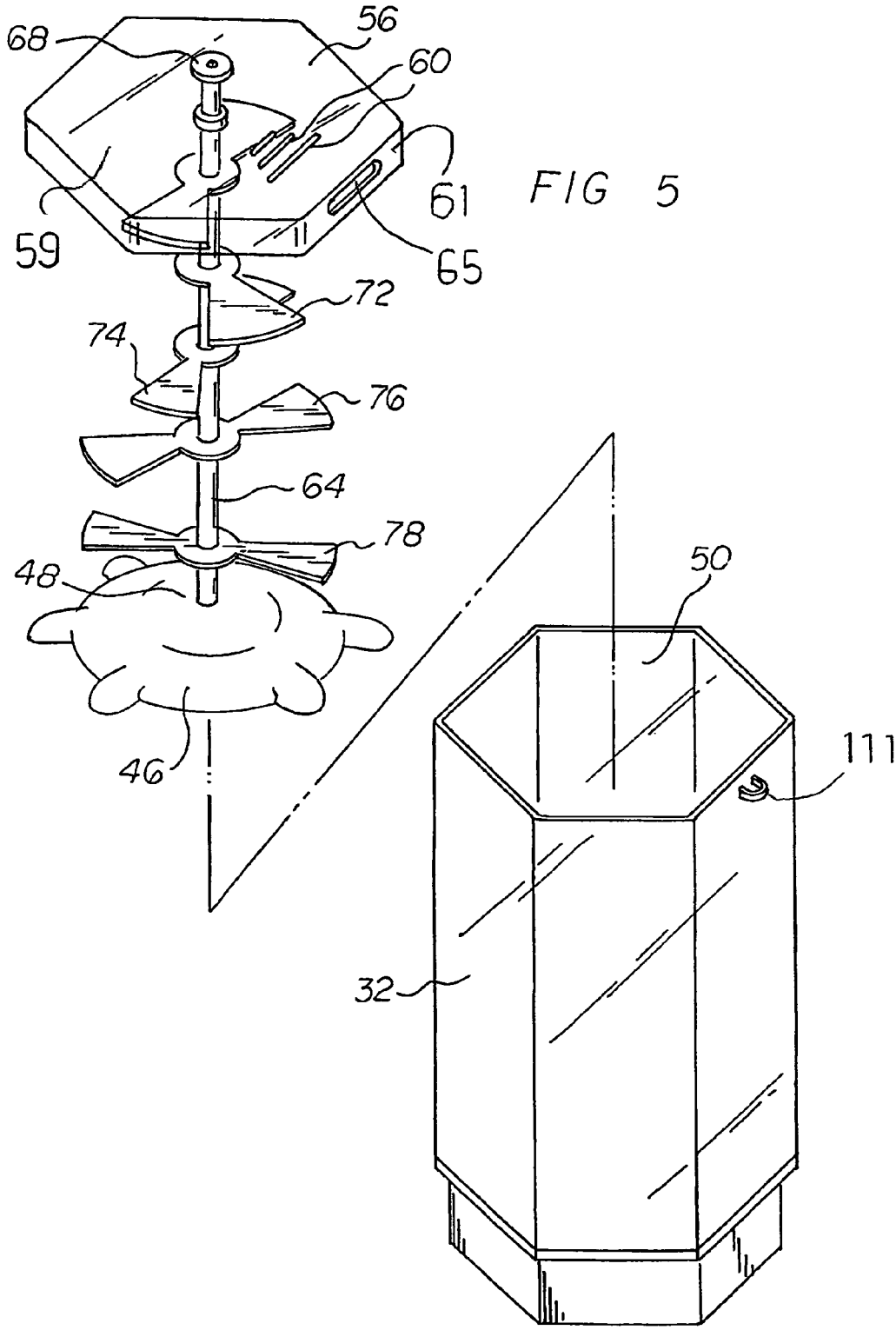
FIG. 5 is a perspective showing of the shaft and its handle and its coin-receiving plates in association with the housing.

A vertical support shaft 64 is next provided. The vertical support shaft has a lower end and an upper end extending upwardly through the central aperture in the lid. A handle 68 is provided on the upper end of the support shaft for being turned by a player. The support shaft has five axially spaced horizontal plates 70, 72, 74, 76, 78. Each of the plates is formed with a plurality of planar coin-receiving surfaces 80, preferably two surfaces per plate. Note FIG. 5. Each of the coin-receiving surfaces is in a generally pie-shaped configuration. Cutouts 82 are provided between the surfaces. The coin-receiving surface of the upper plate is greater in size than the size of the coin-receiving surfaces of the plates beneath the coin-receiving surface of the upper plate. The plates do not touch the interior surface of the chamber, and there is a substantial gap 79 between each of the plates and the interior surface of the chamber. The gap is important for the game to function properly, to prevent players from catching a coin between the plate and the wall, and allowing the player to walk the coin downward. The gap prevents this from happening, and makes the game more skill related. The plates and coin-receiving surfaces are configured to be rotated by a player upon the rotation of the upper end of the shaft.

Next provided is a base support plate 48 removably positionable in the chamber of the housing. The base support plate is formed with a central aperture for rotatably receiving the lower end of the vertical support shaft. The base support plate has a radially exterior periphery 46 with six outwardly extending fingers positionable in close proximity to the housing. The base support plate also having a flat lower surface and an upper surface tapering downwardly from the central aperture.

Next provided are security components between the lid and the housing. The security components include a slot in the lid and a housing loop 111 and a padlock 112 for selectively locking and unlocking the lid onto the housing to secure coins within the housings.

An alternate embodiment of the invention is shown in FIGS. 6 and 7 and includes a vertical sign 116 which is provided for supporting indicia relating to the nature of the game and prizes to be won and charities to be helped. The sign includes a horizontal lower extension 118 formed with an aperture land a fastener for removably joining the sign to the upper end of the housing. In this manner when a coin is dropped through one of the slots and the handle is turned by the player, a coin may fall and possibly rest on one of the plates. Upon further movement of the plates, the coin may possibly be moved to rest on one of the lower plates with the score of the player increasing as a function of the lower most plate in which the player may make a coin rest.

The sign has a periphery in an inverted U-shaped configuration with a light 86 within the periphery.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A coin dropping game system comprising:

a lower base and an upper base;

a housing having an interior chamber and an exterior surface, the housing being fabricated of a plastic material and having an open upper end and an open bottom end coupled to the top of the upper base and a transparent side wall there between;

a lid having an upper exterior surface and an interior surface, the lid having a downwardly projecting lip, the lid being positioned over the upper end of the housing with the lip enclosing the upper end of the housing, the lid having with a central aperture there through with a plurality of slots there through;

a vertical support shaft having a lower end rotatably coupled with respect to the upper base and having an upper end extending upwardly through the central aperture in the lid with a handle thereon, the support shaft having axially spaced horizontal plates with a plurality of planar coin-receiving surfaces; and a base support plate removably positionable in the chamber of the housing, the base support plate being formed with a central aperture for rotatably receiving the lower end of the vertical support shaft and a radially exterior periphery with a plurality of outwardly extending fingers positionable in close proximity to the housing with a substantial gap between the outwardly extending fingers of the vertical support shaft, the base support plate also having an upper surface tapering downwardly from the central aperture.

2. The system as set forth in claim 1 and further including the lid having a locking slot located through the lip of the lid;

the vertical support shaft having an uppermost plate with cutouts being located between the coin-receiving surfaces of the plates, the coin receiving surface of the upper plate being greater in size than the size of the coin-receiving surfaces of the plates there beneath, the plates and coin-receiving surfaces configured to be rotated by a player upon the rotation of the upper end of the shaft.

3. The system as set forth in claim 2 and further including security components between the lid and the housing including adjacent holes in the lid and the housing with a padlock for selectively locking and unlocking the lid onto the housing to secure coins within the housings.

* * * * *